United States Patent [19]

Ajiro

[11] Patent Number: 4,650,438

[45] Date of Patent: Mar. 17, 1987

[54] MAGNETICALLY COUPLED TOY

[75] Inventor: Yutaka Ajiro, Tokyo, Japan

[73] Assignee: Tomy Kogyo Co. Inc., Tokyo, Japan

[21] Appl. No.: 696,015

[22] Filed: Jan. 29, 1985

[51] Int. Cl.[4] ..... A63H 33/26

[52] U.S. Cl. ..... 446/136; 273/1 GB

[58] Field of Search ..... 446/136, 135, 134, 129, 446/454; 273/1 GB, 1 GD

[56] References Cited

U.S. PATENT DOCUMENTS

| | | | |
|---|---|---|---|
| 3,525,175 | 8/1970 | Wolf | 446/136 |
| 3,823,941 | 7/1974 | Ochi et al. | 273/1 GB |
| 4,106,768 | 8/1978 | Kanno | 273/1 GB |

FOREIGN PATENT DOCUMENTS

| | | | |
|---|---|---|---|
| 1184263 | 12/1964 | Fed. Rep. of Germany | 446/135 |

*Primary Examiner*—Mickey Yu

*Attorney, Agent, or Firm*—K. H. Boswell

[57] ABSTRACT

A toy has a housing with a surface therein. Located underneath the surface is a pivot member which carries a carriage member thereon. The pivot member rotates about an axis of rotation, and the carriage member slides on the pivot member so as to move radially inwardly and outwardly from the axis of rotation. The carriage member carries a first magnet. An object carrying a second magnet is located on the top of the surface. Movement of the first magnet underneath the surface is communicated to the object on top of the surface via magnetic coupling between the two magnets. The combination of the rotational movement of the pivot member and the linear radial movement of the carriage member, results in complex movement of the object on the surface of the housing.

16 Claims, 6 Drawing Figures

10
12
14
16
18
20
26
32
4
5
6

MAGNETICALLY COUPLED TOY

BACKGROUND OF INVENTION

This invention is directed to a toy wherein an object is magnetically coupled across a surface to a carriage which is movable both circumferentially and radially with respect to an axis of rotation. The invention utilizes a transfer member capable of transferring motion for radial movement of the carriage across the axis of rotation irrespective of the circumferential movement of the carriage.

A variety of toys are known which utilize a first magnet located below a surface to move a second magnet or other magnetically susceptible material across the top of the surface. Normally the second magnet would be located within the object, such as a vehicle or the like, such that the vehicle or the like is seemingly moved across the surface without any visual coupling or controlling means for the vehicle.

The earliest of these games simply had the first magnet below the surface move in a constant repetitive pathway. Recognizing the limitations of such repetitive movement, others have sought to sophisticate these toys allowing for movement in a more complex manner. In this regard, a variety of toys are known which utilize movement in both an X and Y direction which is accomplished by attaching the magnet to a support which is movable along mutually perpendicular axes by two control means. A first of these control means moves the support across the Y axis, and the second across the X axis. This dual control requires a great deal of coordination for the user of the toy, and as such, this type of toy is generally not suitable for use by young children.

Other magnetically coupled toys have utilized tracks of complex shapes. The magnet located below the surface follows these complex shaped tracks. These, however, also are fixed with regard to the pattern of movement. A very similar type of toy utilizes a magnet attached to a flexible belt. The flexible belt can, of course, move through a variety of convolutions. But, as with tracks and the earlier toys, again, the pathway of movement is fixed.

BRIEF DESCRIPTION OF THE INVENTION

In view of the above, it is the broad object of this invention to provide a toy which utilizes a magnetic couple for movement of an object across a surface with the movement being directed via a moving carriage below the surface. It is a further object of this invention to provide such a magnetically coupled toy which allows for circumferential movement around an axis of rotation coupled with radial movement toward and away from the same axis of rotation. Additionally, it is an object of this invention to provide a toy which, because of the engineering principles incorporated therein, is susceptible to simple, efficient and economic construction and assembly, while still durable in use and economical in manufacture. Further, it is an object of this invention to provide a toy which can provide for many hours of enjoyable use by the operator of the same.

These and other objects, as will become evident from the remainder of this specification, are achieved in a toy which comprises a housing, said housing including a surface, said surface having an upper side and a lower side; at least one object, said object freely positionable on the upper side of said surface, said object including a first mangetic couple means, said first magnetic couple means for magnetically coupling with a further magnetic couple means; a pivot means rotatably mounted on said housing in association with said lower side of said surface, said pivot means rotatable about an axis of rotation below the lower side of said surface; pivot means control means located on said housing in operative association with said pivot means, said pivot means control means for rotating said pivot means about said axis of rotation; carriage means movably mounted on said pivot means so as to rotate with said pivot means and to move linearly along a path which is essentially radial with respect to said axis of rotation; carriage means control means operatively associated with said carriage means, said carriage means control means for linearly moving said carriage means on said pivot means; and said carriage means including a second magnetic couple means magnetically coupling with said first magnetic couple means through said surface whereby said object moves across the upper side of said surface in response to movement of said carriage means across said lower side of said surface, said object moving circumferentially in response to rotation of said pivot means about said axis of rotation and said object moving radially with respect to said axis of rotation in response to movement of said carriage means on said pivot means.

Further, these objects are achieved, as are outlined in the preceding paragraph, when augmented by said pivot means control means including a pivot support member, at least a portion of said pivot support member being cylindrical in shape and positioned coaxial with said axis of rotation; said carriage means control means including a hollow cylindrical transfer member, said transfer member positioned around said cylindrical portion of said pivot support member and movable axially with respect to said axis of rotation; said carriage means control means further including a gear train means, said gear train means for transferring motion; said transfer member including a plurality of circular gear teeth circumferentially extending around the cylindrical surface of said transfer member and axially spaced with respect to one another; and said teeth on said transfer member operatively associated with said gear train so as to be movable by said gear train.

BRIEF DESCRIPTION OF THE DRAWINGS

This invention will be better understood when taken in conjunction with the drawings wherein.

This invention utilizes certain principles and/or concepts as are set forth in the claims appended to this specification. Those skilled in the toy arts will realize that these principles and/or concepts are capable of being utilized in a variety of embodiments which may differ from the embodiment utilized for illustrative purposes herein. For this reason, this invention should not be construed as being limited solely to the illustrative embodiment, but should only be construed in view of the claims.

DETAILED DESCRIPTION OF THE INVENTION

Figure 1:
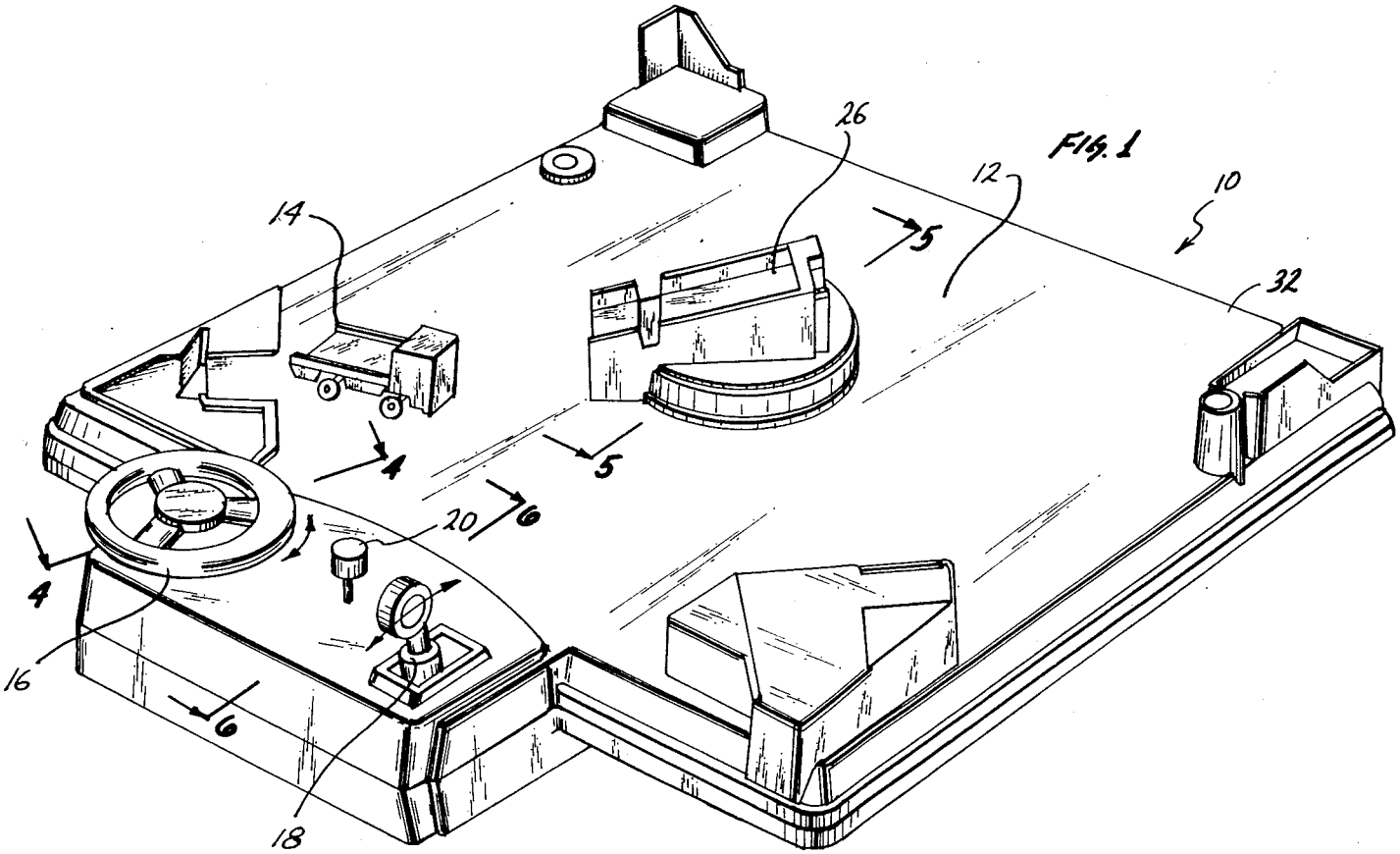
FIG. 1 is an isometric view of an illustrative toy embodying the principles of the invention.

In FIG. 1 a toy 10 is shown. The toy 10 is generally flat in nature and sits on a table or the like. It includes a support surface 12 on which rests an object 14 shaped, for instance, like a truck. The truck 14 is magnetically coupled to other components, hereinafter explained, which are positioned below the surface 12.

The operator of the toy 10 utilizes three controls during play with the toy 10. These include a control wheel 16, a shifting knob 18, and a wind-up knob 20. Additionally, there are other fixed items located on the surface 12 which are utilized in conjunction with the truck 14 during play. These, however, do not form a part of the invention, and as such, are not described.

Figure 6:
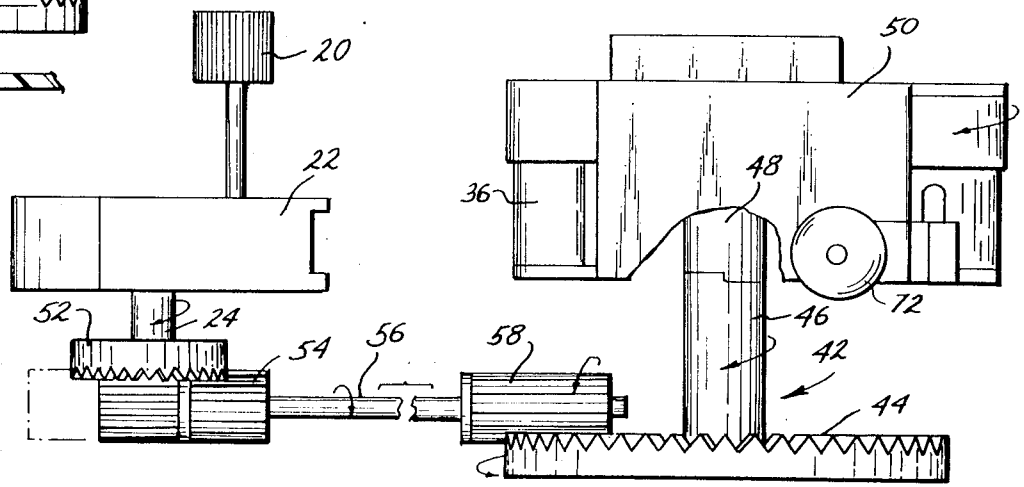
FIG. 6 is a side elevational view about the line 6—6 of FIG. 1 with certain components partly broken away for clarity of underneath components.

The wind-up knob 20 is utilized to energize a small spring wound motor 22 seen in FIG. 6. The motor 22 is of standard construction and as such, a detailed explanation of it is not necessary for the understanding of this invention. It is simply the type of motor which can be wound by twisting its appropriate wind-up knob 20 so as to produce a rotary output at its output shaft 24.

The shifting knob 18 has three positions. The central of these positions wherein a shifting knob 18 is essentially located vertically, is an off position. As hereinafter explained, when the shifting knob 18 is in this position, the output from the motor 22 is locked, and as such, during this time the motor 22 will not wind down or otherwise impart any motion to the truck 14. When the shifting lever 18 is pushed forward, the truck 14 will go counterclockwise around the surface 12. And when the shifting lever 18 is pulled backward toward the operator of the toy, the truck 14 will go clockwise around the surface 12.

The control wheel 16 is utilized for radially positioning the truck 14 away from and toward the center of the surface 12. If, for instance, the truck 14 is going around in a clockwise direction close to the center abutment 26 and the child playing with the toy 10 desires to move the truck 14 outwardly toward the edge of the playing surface 12, the control wheel 16 is turned clockwise, and in response thereto, the truck 14 moves outwardly from the center abutment 26. To move the truck 14 back toward the center abutment 26, as it goes around the center abutment either clockwise or counterclockwise, the control wheel 16 is moved in the opposite direction.

In playing with the toy 10, the child first winds the motor 22 utilizing the wind-up knob 20. This is best done when the shift lever 18 is in the vertical or locked position. As explained previously, to move the truck 14 inwardly or outwardly, radially from the center abutment 26, the control wheel 16 is turned. To change direction of the truck 14 from a clockwise to a counterclockwise, or vice versa, the shift lever 18 is utilized, either pushing it forward or pulling it backward. To stop movement of the truck 14 anytime, the shift lever 18 is simply positioned in the central or stop position.

Figure 2:
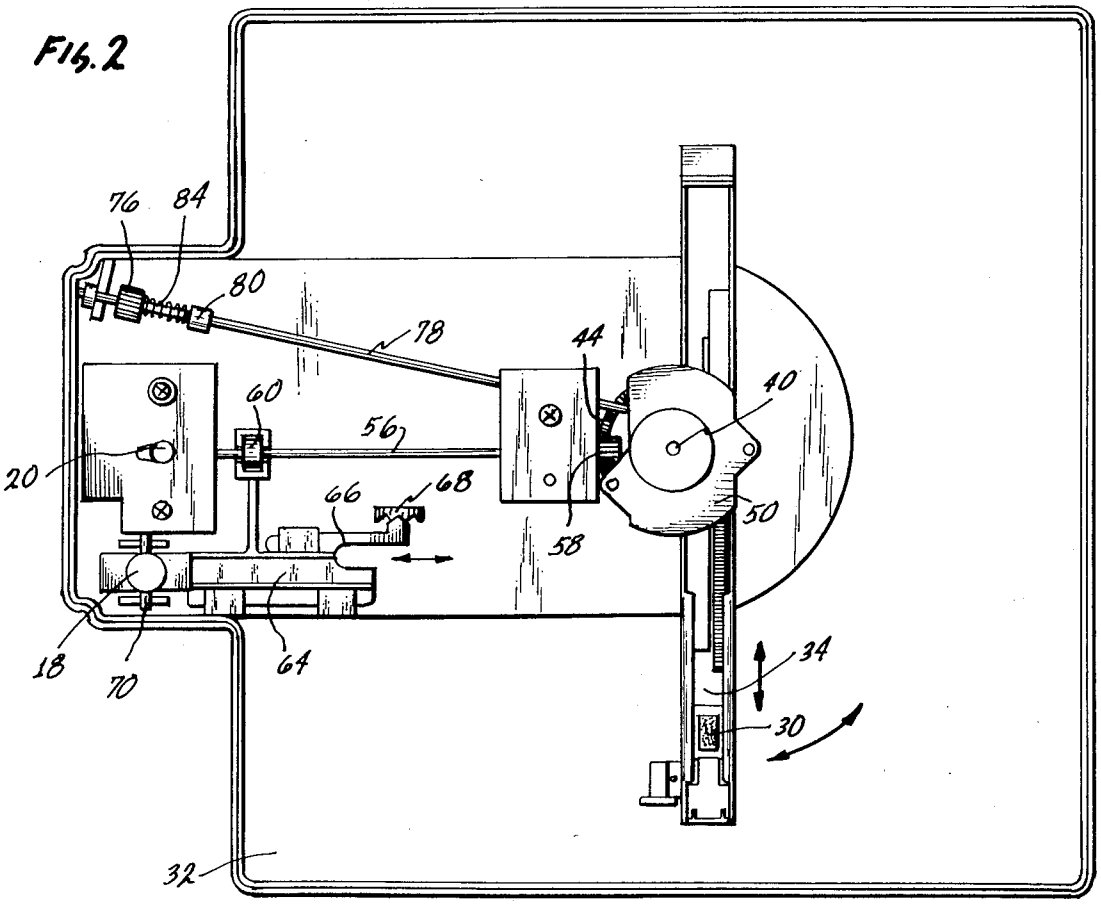
FIG. 2 is a top elevational view of the toy of FIG. 1 with the top housing of the toy removed for clarity of the internal components.
Figure 5:
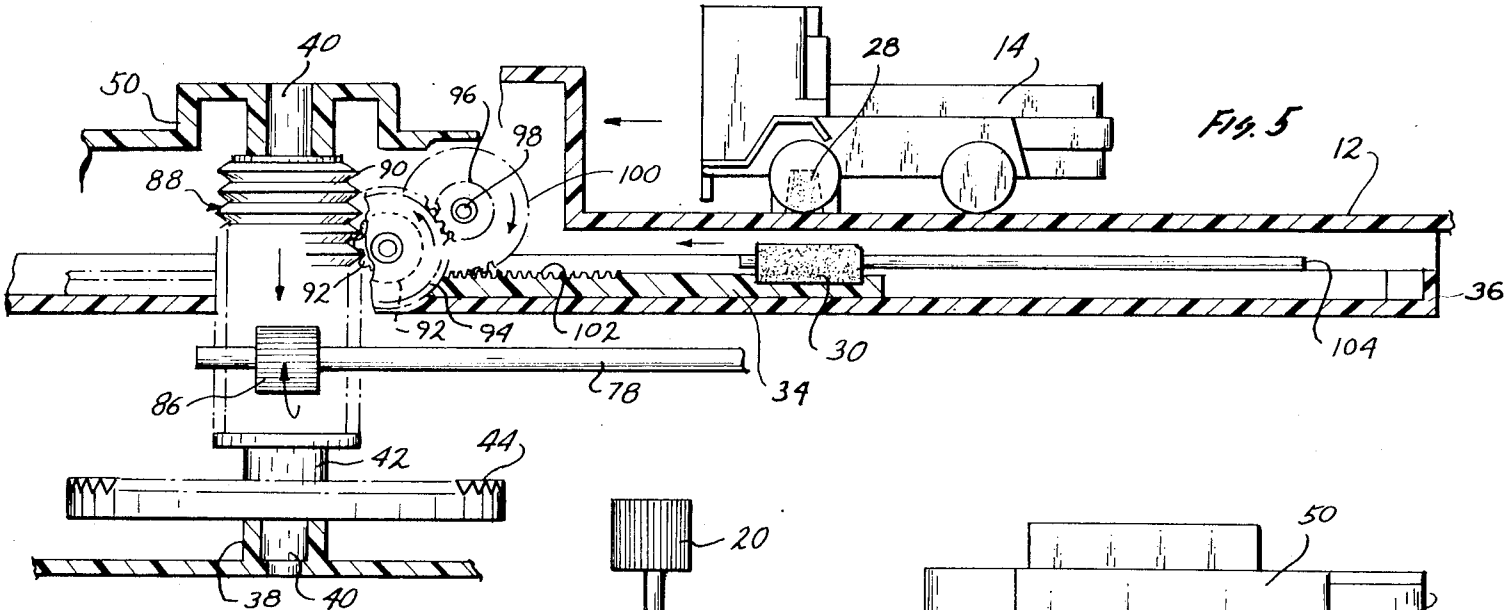
FIG. 5 is a side elevational view in section about the line 5—5 of FIG. 1.

The truck 14 has a small magnet 28 located centrally in its undercarriage in line with the front wheel of the truck 14. This can be seen in FIG. 5. A second magnet, magnet 30, which is shown in both FIGS. 2 and 5, is located underneath the surface 12 within the interior of housing 32 of the toy 10. The surface 12 is formed of a magnetic transparent material such as plastic or the like. This allows the lines of force from the magnet 30 to interact with the magnet 28 so as to magnetically couple the magnet 28 to the magnet 30. Because of this, the magnet 28 will follow the movement of the magnet 30 and the truck 14 will be moved over the upper side of the surface 12 in response to movement of the magnet 30 adjacent to the lower side of the surface 12.

Figure 3:
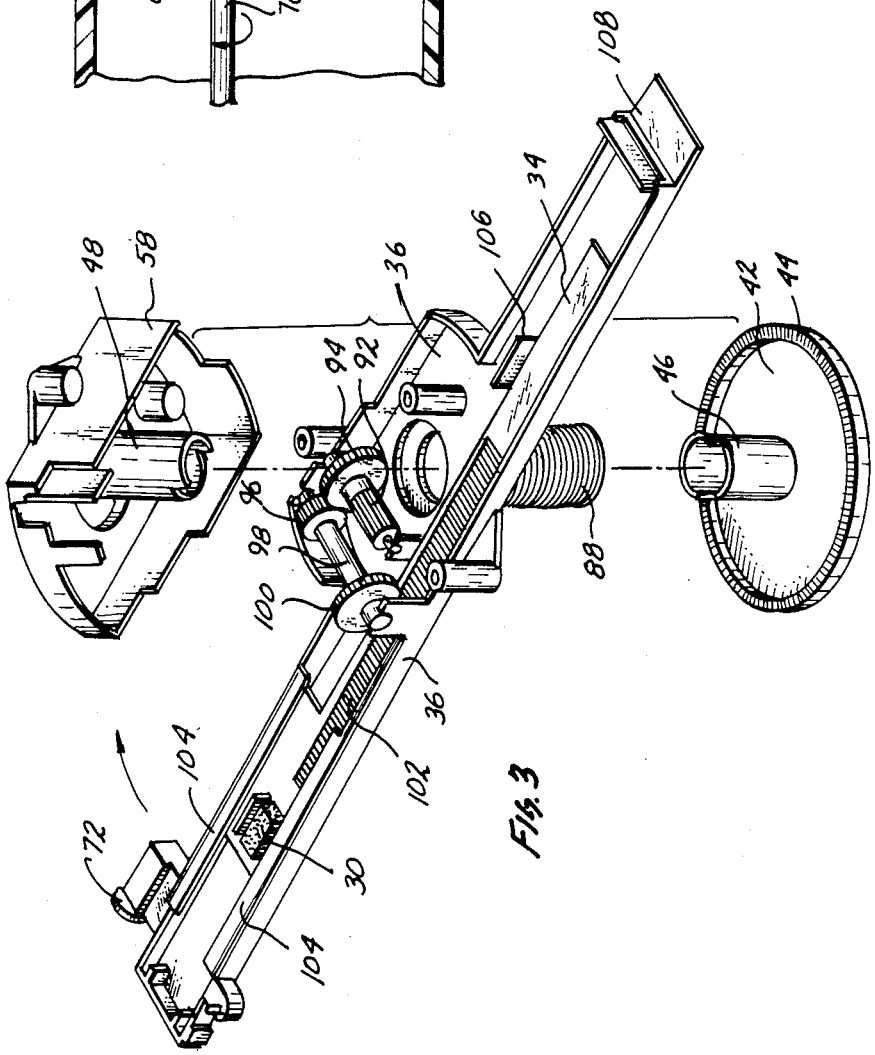
FIG. 3 is an exploded isometric view of the central area of FIG. 2.

The magnet 30 is located on one end of an elongated carriage member 34. In turn, the carriage member 34 is carried on a pivot member 36. The pivot member 36 rotates about an axis of rotation which is located below the center abutment 26. The carriage member 34 moves linearly back and forth on the pivot member 36. As can be seen in FIG. 3, the carriage member 34 is located just in front of the center line which would constitute the axis of rotation. The carriage member 34 does not move directly, radially, right through the center line, but, in fact, is slightly displaced off center to this center line. For all practical purposes, however, movement of the carriage member 34 linearly back and forth across the pivot member 36 would be considered as radial to the axis of rotation of the pivot member 36.

A small boss 38 is formed in the bottom surface of the housing 32. A central shaft 40 fits within this boss 38 and is supported by the boss 38. Fitting around the shaft 40 is a pivot support member 42. The pivot support member 42 has a crown gear 44 intrically formed at its bottommost component. It includes a cylindrical collar 46 which fits around the shaft 40. The top of the cylindrical collar 46 is notched so as to mate with a cylindrical extension 48 which extends downwardly from pivot member cap 50.

The pivot member 36 is attached to the pivot member cap 50 by appropriate screws (not separately shown or numbered) which pass through the cap and then into the pivot member 36. Thus, the pivot member 36 is suspended from the cap 50 with the cap 50 resting via the cylindrical extension 48 on through the pivot member 42. Because of the interlocking of the end of the cylindrical extension 48, with the top of the cylindrical collar 46, rotation of the pivot support member 42 is transferred to the cap 50, which in turn transfers it to the pivot member 36.

As seen in FIG. 6, a crown gear 52 is attached to the motor output shaft 24. An elongated pinon 54 is fixed to a shaft 56 which is journalled within the housing 32. Fixed to the other end of shaft 56 is an elongated pinon 58. The elongated pinon 58 meshes with the crown gear 44 formed on the pivot support member 42.

Fixed to the shaft 56, inbetween the pinons 54 and 58, is a bushing 60. The bushing 60 fits within a small bearing case 62 which is formed as an extension of a slide member 64. Also, formed as a part of the slide member 64 is a spring arm 66, the end of which engages a convoluted web 68 which extends upwardly from the bottom of the housing 32. There are three convolutions in the web 68 corresponding to the clockwise, the lock, and the counterclockwise positions of the shifting lever 18.

The shifting lever 18 extends downwardly toward the slide member 64. The shifting lever 18 is a first class lever, and is journalled near its center on axle 70(?). The bottom end of shifting lever 18 engages the slide member 64. If the exposed portion of the shifting lever 18, which is viewable in FIG. 1, is pushed forward, rotation of the shifting lever 18 about the axle 70 is transferred to the slide member 64 so as to pull the slide member 64 backward (to the left as seen in FIG. 2). This moves the bearing case 62 backward and it, in turn, engages the bushing 60 so as to slide the bushing 60 and the shaft 56, to which it is attached, also to the left in FIG. 2. If the exposed end of the shifting lever 18 is pulled back toward the operator of the toy, as seen in FIG. 1, its bottom end moves forward. This causes the slide member 64 to move, as seen in FIG. 2, to the right hand most notch in the web 68. In turn, this movement is communicated via the bearing case 62 to the bushing 60 and the shaft 56. When the shifting lever 18 is vertical, the slide member 64 is positioned as seen in FIG. 2.

The output of the motor 22 is in a constant direction. As the shaft 56 is slid to the left and right as seen in FIG. 2, because of movement of the bushing 60, it positions the pinon 54 such that it engages either the right hand side of crown gear 52 as seen in solid line in FIG. 6, engages both the right and left hand sides of the crown gear 52 when the pinon 54 straddles the crown gear 52, or engages the left hand side of the crown gear 52 as seen in phantom line in FIG. 6. Because the pinon 58 is elongated, irrespective of the position of the pinon 54, pinon 58 is always engaged with the crown gear 44. As seen in solid line in FIG. 6, positioning of the pinon 54 would result in rotation of the crown gear 44 and the pivot member 36, ultimately attached thereto, in one direction. And position of the pinon 54, in phantom line, would result in rotation of the pivot member 36 in the opposite direction. Positioning of the pinon 54 so it engages both sides of the crown gear 52, locks the crown gear 52, which in turn locks the motor 22 to prevent it from unwinding.

In response to rotation of the motor 22, motion is transferred via the gear train (comprised of the crown gear 52, the pinon 54, the shaft 56, the pinon 58, and the crown gear 44) to rotate the pivot member 36 and the carriage member 34, which is carried by the pivot member 36. A small wheel 72, which is journalled to the pivot member 36, rides across the underside of the surface 12 contributing to smooth rotation of the pivot member 32 below the surface 12.

Figure 4:
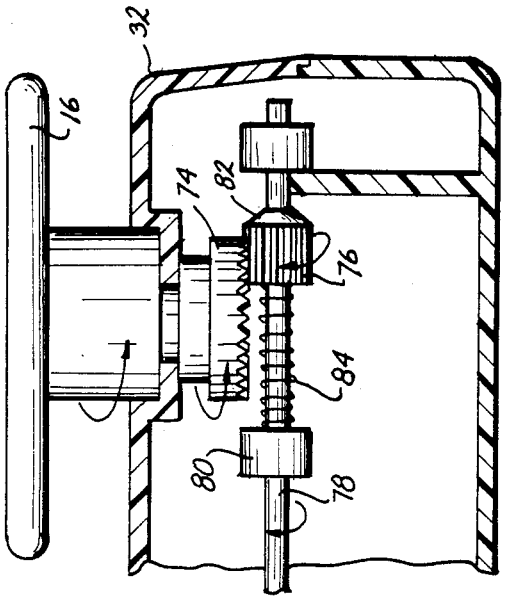
FIG. 4 is a side elevational view in section about the line 4—4 of FIG. 1.

Movement of the carriage member 34 across the pivot member 36 is effected as follows. As seen in FIG. 4, the control wheel 16 is journalled in the housing 32 and includes a crown gear 74 as its lower most component. The crown gear 74 meshes with a pinon 76 which is carried on a shaft 78. A bushing 80 fixed to the shaft 78, and a second bushing 82, also fixed to the shaft 78, have the pinon 76 and a spring 84 located between them. The spring 84, pushing against the bushing 80, drives the pinon 76 against the bushing 82 to provide a frictional engagement between the pinon 76 and the bushing 82 such that the rotation of the pinon 76 by the control wheel 16 is transferred to the shaft 78 to rotate the same.

Referring now to FIGS. 3 and 5, on the end of shaft 78 is a further pinon 86. The pinon 86 is positioned so as to engage a transfer member 88. The transfer member 88 is formed as a hollow elongated cylinder and fits around the cylindrical collar 46 and the cylindrical extension 48 of the pivot support member 42 and the pivot cap member 50 respectively. The transfer member 88, while fitting around the cylindrical collar 46 and the cylindrical extension 48, does not rotate in conjunction with it. The fit between these components is a loose fit such that movement of the transfer member 88 is not communicated to the cylindrical collar 46 or the cylindrical extension 48, and vice versa.

The transfer member 88 has a plurality of circular extending gear teeth, collectively identified by the numeral 90. Each of the teeth 90 is independent, that is, there is not one continuous thread as with a worm gear, but, instead, a plurality of independent circular extending ridges on the transfer member 88 forming the individual gear teeth 90. The pinon 86 meshes with the gear teeth 90. Rotation of the pinon 86, whether it be clockwise or counterclockwise, depending upon the direction of rotation of the control wheel 16, raises and lowers the transfer member 88. Since the gear teeth 90 are each independently existing ridges on the transfer member 88, even if the transfer member 88 was rotated by any kind of frictional engagement between it and the cylindrical collar 46 and the cylindrical extension 48, its vertical placement, as determined by rotation of the pinon 86, would remain constant, in that the same gear tooth 90 would ride at all times within its appropriate gear teeth on the pinon 86. Because of this, the pivot member 36 can rotate around the transfer member 88 with the rotation of the pivot member 36 and its rotational displacement with respect to the surface 12 totally independent of the vertical positioning of the transfer member 88.

A pinon 92, formed intrically with a spur gear 94, is journalled within the pivot member 36 such that the pinon 92 meshes with the transfer member 88. As the transfer member 88 is raised or lowered depending upon rotation of the pinon 86, ultimately determined by the rotation of the control wheel 16, the pinon 92 and the spur gear 94 are rotated. The spur gear 94 meshes with a pinon 96 which is fixed to a shaft 98. On the other end of the shaft 98 is a spur gear 100.

The carriage member 34 includes a rack of gears 102 on its upper surface. The spur gear 100 meshes with the rack of gears 102. In response to rotation of the spur gear 100, the carriage member 34 is slid backward and forward on the pivot member 36. Thus, in response to rotation of the control wheel 16, the pinon 86 ultimately raises or lowers the transfer member 88, and it, in turn, rotates the gear train composed of gears 92, 94, 96, and 98, to move the gear rack 102 and to slide the carriage member 34.

The pivot member 36 includes two side flanges, collectively identified by the numeral 104, which fit over the carriage member 36. This, in conjunction with an upstanding web 106, holds the slide member 64 in position, allowing it to slide backward and forward across the horizontal extension 108 of the pivot member 36. The horizontal extension 108 and the side flanges 104 and the web 106 serve as a track for the linear back and forth sliding of the carriage member 34 on the pivot member 36.

It is evident that since the pivot member 36 rotates independent of the sliding action on it of the carriage member 34, the magnet 30 can be simultaneously rotated about the axis of rotation passing through the shaft 40, as well as radially moved toward and away from it. The pivot member 36 can be rotated without sliding movement of the carriage member 34 and vice versa. The carriage member 34 can be slid on the pivot member 36 without rotation of the pivot member 36. Alternately, both of these can move simultaneously. This allows for a complex movement of the truck 14 across the surface 12. The truck 14 can either go in a circle, or move directly radially outward, from or toward the center abutment 26, or it can move in a helical manner utilizing both the radial and the circular movement simultaneously.

I claim:

1. A toy which comprises:

a housing, said housing including a surface, said surface having an upper side and a lower side;

at least one object, said object freely positionable on the upper side of said surface, said object including a first magnetic couple means, said first magnetic couple means for magnetically coupling with a further magnetic couple means;

a pivot means rotatably mounted on said housing in association with said lower side of said surface, said pivot means rotatable about an axis of rotation below the lower side of said surface;

pivot means control means located on said housing in operative association with said pivot means, said pivot means control means for rotating said pivot means about said axis of rotation;

carriage means movably mounted on said pivot means so as to rotate with said pivot means and to move linearly along a path which is essentially radial with respect to said axis of rotation;

carriage means control means operatively associated with said carriage means, said carriage means control means for linearly moving said carriage means on said pivot means;

said carriage means control means including an elongated cylindrical shaped transfer member positioned coaxial around at least a portion of said pivot means control means and movable axially with respect to said axis of said rotation;

transfer member moving means for moving said transfer member axially with respect to said axis of rotation, said transfer member moving means operatively associated with said transfer member and capable of axially moving said transfer member;

said carriage means including a second magnetic couple means magnetically coupling with said first magnetic couple means through said surface whereby said object moves across the upper side of said surface in response to movement of said carriage means across said lower side of said surface, said object moving circumferentially in response to rotation of said pivot means about said axis of rotation and said object moving essentially radially with respect to said axis of rotation in response to movement of said carriage means on said pivot means.

2. The toy of claim 1 wherein:

said pivot means control means includes drive means, said drive means for continuously rotating said pivot means on said housing about said axis of rotation.

3. The toy of claim 2 wherein:

said drive means rotating said pivot means both in a clockwise and in a counterclockwise direction.

4. The toy of claim 2 wherein:

said drive means includes a motor, said motor operatively connected to said pivot means so as to rotate said pivot means.

5. The toy of claim 3 wherein:

said drive means includes a motor and a shifting means, said shifting means interspaced between said motor and said pivot means, said shifting means shiftable between at least two positions, one of said positions transferring the rotation of said motor to said pivot means so as to rotate said pivot means in said clockwise direction and a further of said positions transferring the rotation of said motor to said pivot means so as to rotate said pivot means in said counterclockwise direction.

6. The toy of claim 1 wherein:

said pivot means includes track means, said carriage means located on said track means and linearly movable back and forth on said pivot means by moving along said track means.

7. The toy of claim 6 wherein:

said track means includes an elongated track;

said carriage means includes an elongated carriage member located on said pivot means in association with said track so as to move on said pivot means by sliding on said track.

8. The toy of claim 1 wherein:

said pivot means control means includes a pivot support member, said pivot support member rotatably mounted on said housing, said pivot means attaching to said pivot support member;

said pivot means control means further including a drive means, said drive means operatively associated with said pivot support member, said drive means for rotating said pivot support member and said pivot means attached thereto.

9. The toy of claim 8 wherein:

at least a portion of said pivot support member being cylindrical in shape and positioned coaxial with said axis of rotation;

said transfer member positioned around said cylindrical portion of said pivot support member and movable axially with respect to said axis of rotation.

10. The toy of claim 9 wherein:

said transfer member includes a plurality of circular gear teeth circumferentially extending around the cylindrical surface of said transfer member and axially spaced with respect to one another.

11. The toy of claim 10 further including:

a gear train means for transferring motion and an operator control;

said operator control movably mounted on said housing in a position so as to be movable by an operator of said toy;

said gear train means operatively connecting said operator control to said transfer member whereby said transfer member moves axially along said axis of rotation in response to movement of said operator control.

12. The toy of claim 11 wherein:

said pivot means includes track means, said carriage means located on said track means and linearly movable back and forth on said pivot means by moving along said track means;

said track means includes an elongated track;

said carriage means includes an elongated carriage member located on said pivot means in association with said track so as to move on said pivot means by sliding on said track.

13. The toy of claim 12 wherein:

said pivot means further includes a second gear train, said second gear train located on said pivot means, said second gear train in operative association with said transfer member;

said carriage member including a gear located thereon, said gear in operative association with said second gear train means whereby motion movement inparted to said operator control is transferred to said carriage member via said first gear train means, said transfer member and said second gear train means.

14. A toy which comprises:

a housing, said housing including a surface, said surface having an upper side and a lower side;

at least one object, said object freely positionable on the upper side of said surface, said object including a first magnetic couple means, said first magnetic couple means for magnetically coupling with a further magnetic couple means;

a pivot means rotatably mounted on said housing in association with said lower side of said surface, said pivot means rotatable about an axis of rotation below the lower side of said surface;

pivot means control means located on said housing in operative association with said pivot means, said pivot means control means for rotating said pivot means about said axis of rotation;

carriage means movably mounted on said pivot means so as to rotate with said pivot means and to move linearly along a path which is essentially radial with respect to said axis of rotation;

carriage means control means operatively associated with said carriage means, said carriage means control means for linearly moving said carriage means on said pivot means;

said carriage means including a second magnetic couple means magnetically coupling with said first magnetic couple means through said surface whereby said object moves across the upper side of said surface in response to movement of said carriage means across said lower side of said surface, said object moving circumferentially in response to rotation of said pivot means about said axis of rotation and said object moving radially with respect to said axis of rotation in response to movement of said carriage means on said pivot means;

said pivot means control means including a pivot support member, at least a portion of said pivot support member being cylindrical in shape and positioned coaxial with said axis of rotation;

said carriage means control means including a hollow cylindrical transfer member, said transfer member positioned around said cylindrical portion of said pivot support member and movable axially with respect to said axis of rotation;

said carriage means control means further including a gear train means, said gear train means for transferring motion;

said transfer member including a plurality of circular gear teeth circumferentially extending around the cylindrical surface of said transfer member and axially spaced with respect to one another;

said teeth on said transfer member operatively associated with said gear train so as to be movable by said gear train.

15. The toy of claim 14 wherein:

said pivot means control means includes a motor and a shifting means, said shifting means interspaced between said motor and said pivot means, said shifting means shiftable between at least two positions, one of said positions transferring the rotation of said motor to said pivot means so as to rotate said pivot means in a clockwise direction and a further of said positions transferring the rotation of said motor to said pivot means so as to rotate said pivot means in a counter-clockwise direction.

16. The toy of claim 15 wherein:

said pivot means includes an elongated track;

said carriage means includes an elongated carriage member located on said pivot means in association with said track so as to move on said pivot means by sliding on said track;

said pivot means further includes a second gear train means, said second gear train means located on said pivot means, said second gear train means in operative association with said transfer member;

said carriage member including a gear located thereon, said gear in operative association with said second gear train means whereby motion movement inparted to said operator control is transferred to said carriage member via said first gear train means, said transfer member and said second gear train means.

* * * * *

UNITED STATES PATENT AND TRADEMARK OFFICE

CERTIFICATE OF CORRECTION

PATENT NO. : 4,650,438

DATED : MARCH 17, 1987

INVENTOR(S) : YUTAKA AJIRO

It is certified that error appears in the above-identified patent and that said Letters Patent is hereby corrected as shown below:

Column 4, line 31, "intrically" should be --integrally--,

Column 4, line 31, "at" should be --as--,

Column 4, line 65, delete "(?)."

Signed and Sealed this

Twenty-sixth Day of April, 1988

*Attest:*

*Attesting Officer*

DONALD J. QUIGG

*Commissioner of Patents and Trademarks*